US008201741B2

(12) United States Patent
Bennetts et al.

(10) Patent No.: US 8,201,741 B2
(45) Date of Patent: Jun. 19, 2012

(54) TRAJECTORY COMPENSATING SIGHTING DEVICE SYSTEMS AND METHODS

(75) Inventors: Steven Anthony Bennetts, Kersey, CO (US); Kenneth Lawrence Barkdoll, Denver, CO (US)

(73) Assignee: Burris Corporation, Greeley, CO (US)

( * ) Notice: Subject to any disclaimer, the term of this patent is extended or adjusted under 35 U.S.C. 154(b) by 259 days.

(21) Appl. No.: 12/647,979

(22) Filed: Dec. 28, 2009

(65) Prior Publication Data

US 2010/0301116 A1 Dec. 2, 2010

Related U.S. Application Data

(63) Continuation-in-part of application No. 11/347,061, filed on Feb. 3, 2006, now Pat. No. 7,703,679.

(51) Int. Cl.
*G06K 7/10* (2006.01)

(52) U.S. Cl. ..... 235/454

(58) Field of Classification Search ..... 235/454; 42/119, 114, 132

See application file for complete search history.

(56) References Cited

U.S. PATENT DOCUMENTS

| | | | | |
|---|---|---|---|---|
| 722,910 | A | | 3/1903 | Saegmuller |
| 2,381,101 | A | | 8/1945 | Bausch |
| 3,153,856 | A | | 10/1964 | Felix |
| 3,183,594 | A | | 5/1965 | Panunzi |
| 3,315,362 | A | | 4/1967 | Palmer |
| 3,611,606 | A | | 10/1971 | Sefried et al. |
| 3,669,523 | A | | 6/1972 | Edwards |
| D234,539 | S | | 3/1975 | Marchetti |
| D234,540 | S | | 3/1975 | Marchetti |
| 3,877,166 | A | | 4/1975 | Ward |
| 3,994,597 | A | | 11/1976 | Calder et al. |
| 4,264,123 | A | | 4/1981 | Mabie |
| 4,523,818 | A | | 6/1985 | Lang et al. |
| 4,531,052 | A | * | 7/1985 | Moore ..... 235/404 |
| 4,571,870 | A | | 2/1986 | Heideman et al. |
| 4,630,903 | A | | 12/1986 | Jones |
| 4,643,542 | A | | 2/1987 | Gibson |
| 4,695,161 | A | | 9/1987 | Reed |
| 4,777,754 | A | | 10/1988 | Reynolds, Jr. |
| 4,845,871 | A | | 7/1989 | Swan |
| 5,400,540 | A | | 3/1995 | Solinsky et al. |
| 5,408,359 | A | | 4/1995 | Ferrett et al. |
| 5,426,880 | A | | 6/1995 | Ruger et al. |
| 5,430,967 | A | | 7/1995 | Woodman, III et al. |
| 5,506,727 | A | | 4/1996 | Douglas et al. |
| 5,584,137 | A | | 12/1996 | Teetzel |
| 5,771,623 | A | | 6/1998 | Pemstich et al. |
| 5,784,207 | A | | 7/1998 | Satoh |

(Continued)

FOREIGN PATENT DOCUMENTS

| | | |
|---|---|---|
| WO | WO00/50836 | 8/2000 |

(Continued)

*Primary Examiner* — Karl D Frech
(74) *Attorney, Agent, or Firm* — Merchant & Gould P.C.

(57) ABSTRACT

A sighting system for visually acquiring a target includes an optic device having a transmissive LED array affixed thereon. The transmissive LED array includes two or more LED elements that are separately addressable to provide an aiming point. In embodiments, the sighting system receives information from an input system, such as ammunition information or environmental information, executes a ballistics program to determine ballistics information using the received information, and determines a range to the target. A controller calculates an aiming point using the ballistics information and the target range. The controller then addresses or energizes one of the LED elements to provide the aiming point.

19 Claims, 15 Drawing Sheets

U.S. PATENT DOCUMENTS

| | | | |
|---|---|---|---|
| 5,920,995 | A | 7/1999 | Sammut |
| 5,941,489 | A | 8/1999 | Fanelli et al. |
| 5,973,315 | A | 10/1999 | Saldana et al. |
| 6,032,374 | A | 3/2000 | Sammut |
| 6,185,854 | B1 | 2/2001 | Solinsky et al. |
| 6,269,581 | B1 | 8/2001 | Groh |
| 6,363,223 | B1 | 3/2002 | Gordon |
| 6,442,883 | B1 | 9/2002 | Waterman et al. |
| 6,453,595 | B1 | 9/2002 | Sammut |
| 6,516,551 | B2 | 2/2003 | Gaber |
| 6,516,699 | B2 | 2/2003 | Sammut et al. |
| 6,574,901 | B1 | 6/2003 | Solinsky et al. |
| 6,580,555 | B2 | 6/2003 | Crista |
| 6,580,876 | B1 | 6/2003 | Gordon |
| 6,606,813 | B1 | 8/2003 | Squire et al. |
| 6,608,298 | B2 | 8/2003 | Gaber |
| 6,615,531 | B1 | 9/2003 | Holmberg |
| 6,681,512 | B2 | 1/2004 | Sammut |
| 6,721,095 | B2 | 4/2004 | Huber |
| 6,729,062 | B2 | 5/2004 | Thomas et al. |
| 6,792,206 | B2 | 9/2004 | Gordon |
| 6,807,742 | B2 | 10/2004 | Schick et al. |
| 6,813,025 | B2 | 11/2004 | Edwards |
| 6,819,495 | B2 | 11/2004 | Shani et al. |
| 6,862,832 | B2 | 3/2005 | Barrett |
| 7,125,126 | B2 | 10/2006 | Yamamoto |
| 7,292,262 | B2 | 11/2007 | Towery et al. |
| 7,317,520 | B2 | 1/2008 | Wang et al. |
| 7,343,707 | B2 | 3/2008 | Smith, III |
| 2002/0089752 | A1 | 7/2002 | Morgan, III |
| 2004/0047586 | A1 | 3/2004 | Schick et al. |
| 2004/0068913 | A1 | 4/2004 | Solinsky et al. |
| 2004/0088898 | A1 | 5/2004 | Barrett |
| 2004/0144013 | A1 | 7/2004 | Leatherwood |
| 2004/0187374 | A2 | 9/2004 | Solinsky et al. |
| 2004/0231220 | A1 | 11/2004 | McCormick |
| 2004/0234812 | A1 | 11/2004 | Naito et al. |
| 2005/0002668 | A1 | 1/2005 | Gordon |
| 2005/0021282 | A1 | 1/2005 | Sammut et al. |
| 2005/0036109 | A1 | 2/2005 | Blum et al. |
| 2005/0200959 | A1 | 9/2005 | Yamamoto |
| 2005/0252062 | A1 | 11/2005 | Scrogin et al. |
| 2006/0010760 | A1 | 1/2006 | Perkins et al. |
| 2006/0162226 | A1 | 7/2006 | Tai |
| 2006/0164704 | A1 | 7/2006 | Sieczka et al. |
| 2007/0097351 | A1 | 5/2007 | York et al. |
| 2007/0277421 | A1 | 12/2007 | Perkins et al. |

FOREIGN PATENT DOCUMENTS

| | | |
|---|---|---|
| WO | WO03/096216 | 11/2003 |

* cited by examiner

1400

TRAJECTORY COMPENSATING SIGHTING DEVICE SYSTEMS AND METHODS

RELATED APPLICATIONS

This application is a continuation-in-part of prior application Ser. No. 11/347,061, filed Feb. 3, 2006, which application is hereby incorporated by reference.

TECHNICAL FIELD

The present invention relates generally to the field of devices that visually acquire targets. More particularly, the invention relates to the automatic determination and display of a trajectory compensating crosshair for a riflescope.

BACKGROUND

Aiming a rifle or gun requires the consideration of several environmental and other types of factors. When a bullet travels from a rifle to an intended target, several forces affect the flight of the bullet. Gravity causes the bullet to drop in elevation as the bullet travels from the firearm to the target. If a hunter is close to his/her target, as shown in FIG. 1A, the bullet drops very little, represented by the adjusted trajectory 100. However, improvements in firearms and ammunition have allowed hunters to target game from long distances. At these greater distances, gravity causes a bullet to drop in elevation more significantly, as represented by the adjusted trajectory 102 in FIG. 1B. Other factors also affect the flight of the bullet. For instance, wind causes the bullet to move horizontally along the bullet's path of flight. The compensation in a riflescope for the effect wind has on a bullet's flight is often referred to as windage. Humidity, elevation, temperature, and other environmental factors may also affect the flight of the bullet.

Different bullets fired from a gun are affected to a greater or lesser degree by environmental factors. Some bullets have a greater mass, e.g. a .223 caliber bullet has a mass of 55 grains while a .338 Mag bullet has a mass of 225 grains. The more massive bullets are affected less by wind and some other environmental forces. In addition, some bullets travel at higher speeds than other bullets, which also affect the flight of the bullet. All of these factors create a unique bullet trajectory for every shot taken from a rifle.

A hunter, sniper, or other person using a rifle or other firearm, commonly referred to as riflemen, use sighting systems, such as riflescopes, to visually acquire a target and improve their aiming accuracy. Generally, riflescopes provide a magnified field of view 200 of the target 208, as shown in FIG. 2A. By placing an intended target 208 within the field of view 200 defined by a field stop 202 and aiming the rifle with the crosshairs 204 and 206, the riflescope improves the aiming accuracy for a rifleman for shots taken over long distances. Many riflescopes provide a reticle, which is an aiming device superimposed on the field of view 200 and consists of a vertical crosshair 204 and a horizontal crosshair 206. A hunter can use the intersection 210 of the vertical 204 and horizontal 206 crosshairs to aim the rifle. By placing the intersection 210 over the target 208, at longer distances, the hunter can deliver the bullet to the aiming point represented by the intersection 210.

Riflemen must consider and adjust to the different environmental factors and bullet characteristics explained above to ensure the bullet effectively hits the target. To adjust for the bullet trajectory, a rifleman must raise the rifle and effectively aim over the target such that, as the bullet drops along the bullet's flight path, the bullet will still strike the target. For example, the rifleman must place the intersection 210 of the crosshairs above the target 208, as shown in FIG. 2B. This adjustment in aiming is called hold over. Some riflescopes help riflemen with correctly aiming for hold over.

Some reticles include a series of hatches or marks along the vertical and/or horizontal cross-hairs. The hatches can be used to compensate for hold over or windage. Unfortunately, the hatches are generally not labeled and the rifleman must understand which hatch to use for his/her needed bullet type and range to the target. Thus, the riflemen, even with a scope, must determine how to aim the gun using the hatches, and this determination is often inaccurate, which leads to the rifleman missing the intended target.

SUMMARY

The present invention relates to new and improved embodiments of sighting systems for visually acquiring a target. The sighting system comprises an optic device, such as a riflescope, having an aiming component in the optic device. The aiming component may include one or more LCD elements that are addressable by a controller to provide an aiming point that is automatically calculated for the conditions of the desired shot. In embodiments, the sighting system receives information from an input system A controller calculates an aiming point using the ballistics information and the range. The controller then addresses or energizes an aiming element on the aiming component to provide the aiming point.

A more complete appreciation of the present invention and its improvements can be obtained by reference to the accompanying drawings, which are briefly summarized below, to the following detailed description of presently exemplary embodiments of the invention, and to the appended claims.

DETAILED DESCRIPTION OF THE INVENTION

Figure 1A:
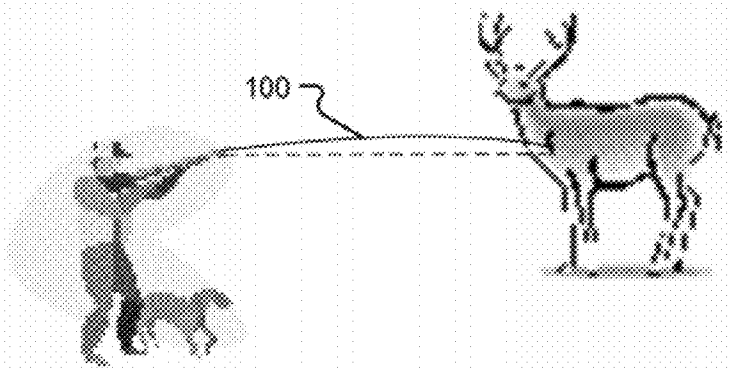
Fig. 1A Prior Art
FIGS. 1A and 1B are simplified representations of the effect of gravity on the flight of a bullet.
Figure 1B:
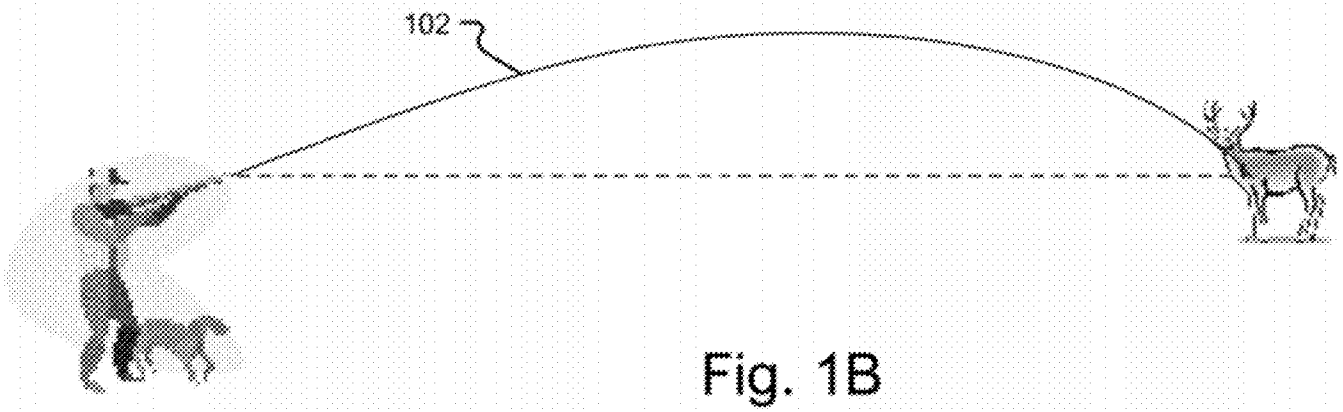
Fig. 1B Prior Art

The present invention will now be described more fully hereinafter with reference to the accompanying drawings, in which embodiments of the invention are shown. The invention may, however, be embodied in many different forms and should not be construed as limited to the embodiments set forth herein. Rather, these embodiments are provided so that the disclosure will be thorough and complete and will fully convey the scope of the invention to those skilled in the art.

The present invention relates to new and improved embodiments of sighting systems and methods for correctly aiming a firearm or other implement. In embodiments, the sighting system includes an optic device, a range input, a controller/processor, an input system, a ballistics program, and an aiming component, possibly affixed to a lens of the optic device. The optic device is any device that can visually acquire a target, such as a riflescope. An exemplary riflescope may be the Euro Diamond 2.5×-IOX-44 mm Matte, 200919 riflescope available from Burris Corporation of Greeley, Colo. The range input may be input from a range finder that may be any device that can determine the distance between the sighting system and an intended target, such as a laser range finder. The range finder may be a separate unit or integrated with the optic device. An exemplary integrated riflescope and laser range finder is the 4×-12×-42 mm, LaserScope available from Burris Corporation of Greeley, Colo. In other embodiments, the user enters the range through the input system 306.

The controller/processor accepts, from the input system, information, for example, Information regarding the bullet and/or cartridge characteristics, rifle characteristics, and/or any environmental considerations. After receiving the input from the input system, the controller/processor requires the range to determine the correct hold over adjustment. The range input provides the range to the target before the rifle is fired. In exemplary embodiments, a range finder, either integral to the riflescope or separate from the riflescope, or another input system, such as a handheld device, provides the range. The controller/processor determines the hold over adjustment and other corrections and automatically addresses or energizes a certain aiming element, such as a LCD element on a transmissive LCD, to provide an accurate aiming point on the riflescope's lens. The aiming point is the displayed aiming element that represents the point in the field of view of the riflescope that should be positioned on the visually acquired target to correctly aim the rifle for the intended shot. By aiming the rifle with the aiming point, the rifleman can correctly aim the rifle for the target range, environmental conditions, cartridge characteristics, or other considerations, without needing to manually calculate corrections using graduated markings on the reticle crosshairs. In exemplary embodiments, the aiming point is a crosshair on a vertical crosshair, a dot, a circle, a donut, a box, or other possible visual representation of the aiming point.

Figure 3:
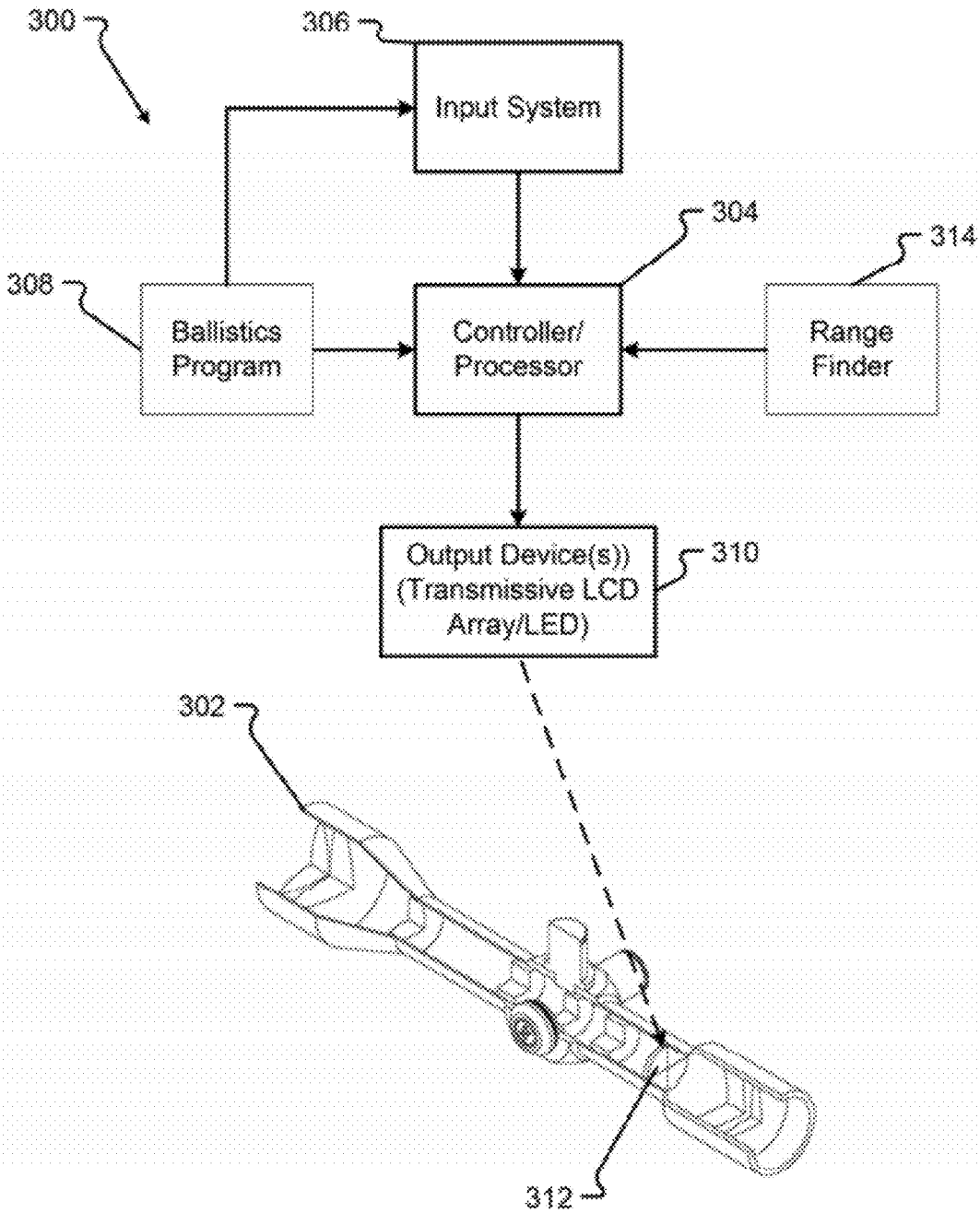
FIG. 3 is a simplified diagram of an exemplary embodiment of a sighting system operable to automatically calculate and provide an aiming point according to the present invention.

An exemplary sighting system 300 for visually acquiring a target and automatically providing a corrected aiming point in accordance with the present invention is shown in FIG. 3. As used herein, a "sighting system" shall be construed broadly and is defined as one or more optical devices and other systems that assist a person in aiming a firearm, a rifle or other implement. The sighting system 300 comprises an optic device 302, such as a rifle scope or optical system attached to a firearm or other implement, an input system 306, a ballistics program 308, a controller/processor 304, and one or more output devices, such as an aiming component 310. In further embodiments, the sighting system also comprises a range input, such as from a range finder 314. Hereinafter, the optic device 302 will often be referred to as the rifle scope or scope, although the present invention is not limited to the use of a riflescope. Additionally, the implement or firearm will hereinafter be referred to as the rifle, although the present invention is not limited to use with rifles or other firearms. In embodiments, the riflescope 302 provides a reticle, as seen on lens 312, or vertical and horizontal crosshairs to aim the rifle.

The controller/processor 304 of the exemplary system 300 receives inputs or data from an input system 306 and a range input, such as a range finder 314 and is operable to execute a ballistics program 308 or receive information from the input system 306 pertaining to the ballistics program 308. The controller/processor 304 uses the input information to determine a correct aiming point for the scope 302. In embodiments, the controller/processor addresses or powers an aiming component 310, for example, a transmissive LCD array, in the riflescope 302. In the exemplary embodiment, the aiming component 310 includes a transmissive LCD array affixed to a plano lens 312 or, simply, a plano, which are defined as a piece of translucent material that has no refractive power. The aiming component may also, in some embodiments, include an organic LED or other LED that superimposes an image of the reticle onto a plano lens. Hereinafter, the aiming component will be described as an LCD array but one skilled in the art will recognize that other embodiments of the aiming component are possible, as explained further in conjunction with FIGS. 11A-11C.

The controller/processor 304 is a hardware or combination hardware/software device for processing the input information, for determining a correct aiming element to address or energize on the aiming component 310, and for controlling the aiming component 310. In exemplary embodiments, the controller/processor 304 is a microcontroller or microprocessor, for example the 8-bit MCS 251 CHMOS microcontroller available from Intel® Corporation. In other embodiments, the controller/processor 304 is a custom-made; application specific integrated circuit or field programmable gate array that is operable to perform the functions described herein. An exemplary microcontroller may be implemented in a ball grid array, pin grid array, or as chip-on-glass to allow the microcontroller to be mounted to the aiming component 310 and control the LCD array 310 without requiring signal transmission over a wire or other connection from a separate or removed location to the aiming component 310. In other embodiments, the controller is a separate component that is communicatively coupled to an addressing chip that is mounted to and energizes the LCD elements on the glass.

Figure 4:
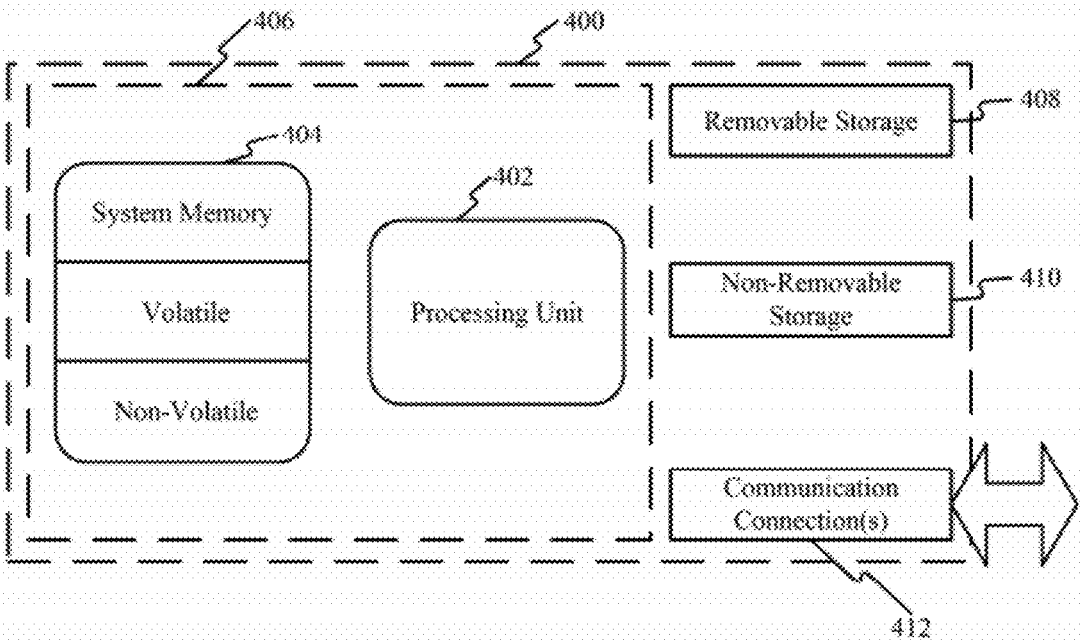
FIG. 4 is block diagram representing an exemplary embodiment of a controller/processor operable to automatically calculate and provide an aiming point according to the present invention.

In embodiments, the controller/processor 304 includes any electronics or electrical devices required to perform the functions described herein. For example, an embodiment of a suitable operating environment in which the present invention may be implemented is shown in FIG. 4. The operating environment is only one example of a suitable operating environment and is not intended to suggest any limitation as to the scope of use or functionality of the invention. Other well known controller/processor systems, environments, and/or configurations that may be suitable for use with the invention include, but are not limited to, hand-held devices, multiprocessor systems, microprocessor-based systems, programmable consumer electronics, or other computing environments that include any of the above systems or devices, and the like.

Figure 10A:
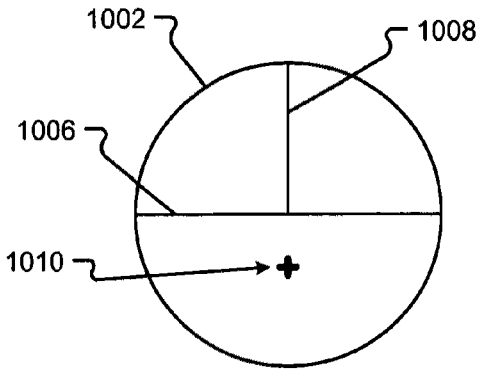
FIGS. 10A-10C illustrate embodiments of aiming components.
Figure 10B:
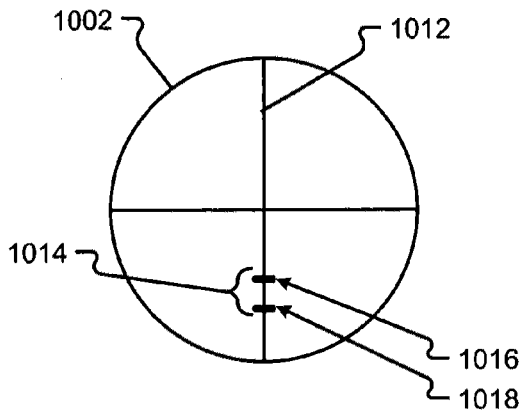
Figure 10C:
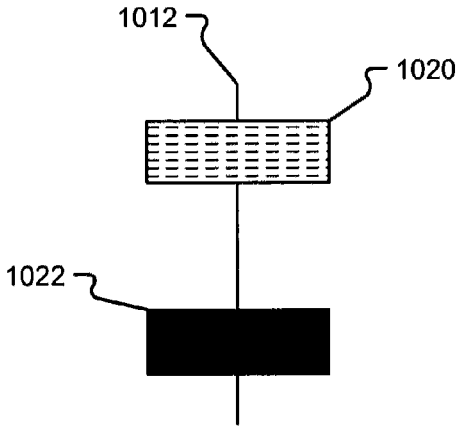
Figure 11A:
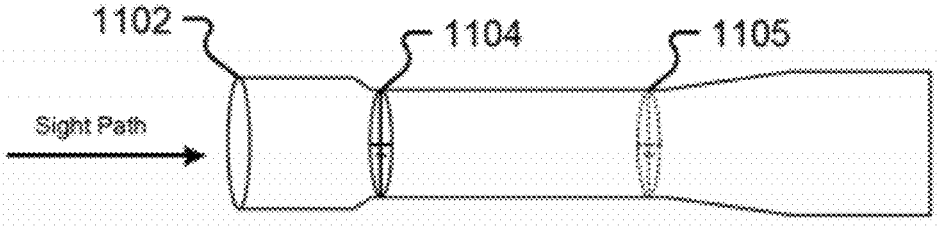
FIGS. 11A-11C show three exemplary embodiments of an aiming component.
Figure 11B:
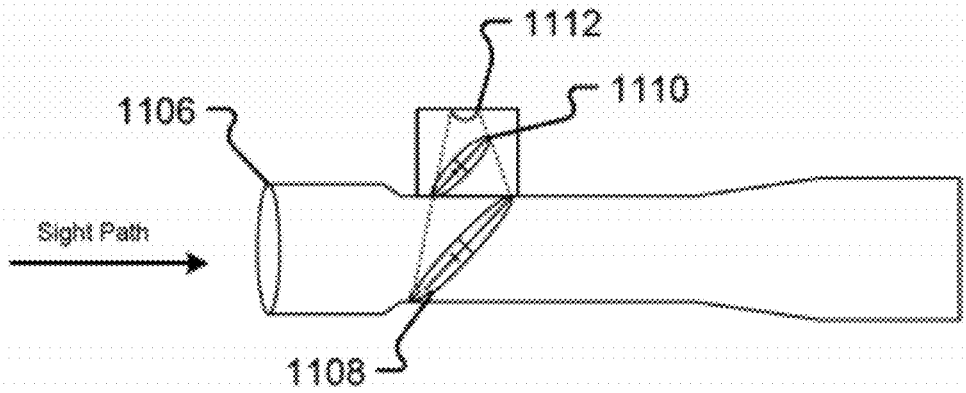
Figure 11C:
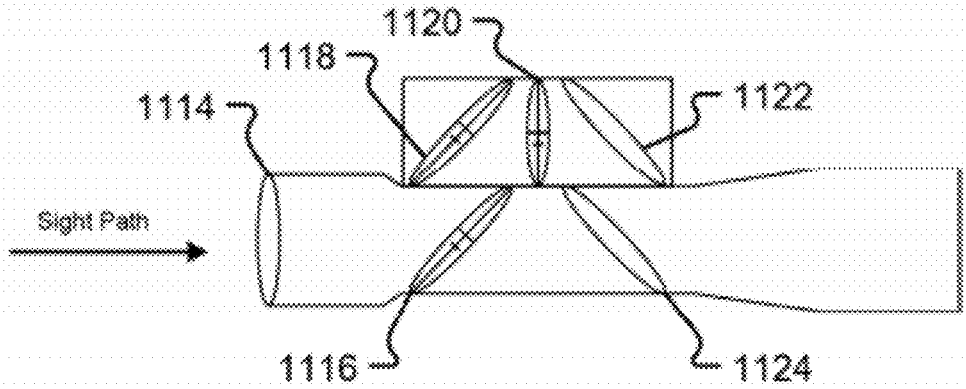

FIGS. 11A, 11B and 11C show three exemplary embodiments of an aiming component. Exemplary sighting system 1102, shown in FIG. 11A, provides a riflescope with either a rear focal plane transmissive LCD array 1104 or a front focal plane transmissive LCD array 1105, similar to the LCD array 310 shown in FIG. 3. A second embodiment of a sighting system 1106 shown in FIG. 11B uses a non-transmissive LCD or an organic LED 1110 to project an image onto a lens 1108. If a non-transmissive LCD is used, a backlight 1112 helps project the image onto the lens 1108. Backlit LCDs and organic LEDs are known in the art and will not be explained further. In another exemplary embodiment of a sighting system 1114 shown in FIG. 11C, the sight path is split. A first lens 1124 splits the incoming image, and a first mirror 1122 directs the image through a non-transmissive LCD component 1120. A second mirror 1118 then directs the image to a second lens 1116, which directs the image and the superimposed aiming point to the rifleman. The transmissive LCD array 1104 will be explained in more detail below, in conjunction with FIGS. 5A, 5B, 6A, 6B, 6C, 6D, 7, 10A, 10B, and 10C. One skilled in the art will recognize how the description below applies to the other exemplary embodiments shown in FIGS. 11B and 11C.

With reference to FIG. 4, an exemplary computing environment for implementing the embodiments of the controller/processor 302 (FIG. 3) includes a computing device, such as computing device 400. In its most basic configuration, computing device 400 typically includes at least one processing unit 402 and memory 404. Depending on the exact configuration and type of computing device 400, memory 404 may be volatile (such as RAM), non-volatile (such as ROM, flash memory, etc.), or some combination of the two. The most basic configuration of the controller/processor is illustrated in FIG. 4 by dashed line 406.

Additionally, device 400 may also have additional features/functionality. For example, device 400 may also include additional storage. Such additional storage is illustrated in FIG. 4 by removable storage 408 and non-removable storage 410. Such computer storage media includes volatile and nonvolatile, removable and non-removable media implemented in any method or technology for storage of information such as computer readable instructions, data structures, program modules, or other data. Memory 404, removable storage 408, and non-removable storage 410 are all examples of computer storage media. Computer storage media includes, but is not limited to, RAM, ROM, EEPROM, flash memory, or other memory technology. Any such computer storage media may be part of device 400.

Device 400 may also contain communications connection(s) 412 that allow the device to communicate with other devices. Communications connection(s) 412 is an example of communication media. Communication media typically embodies computer readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media.

Computing device 400 typically includes at least some form of computer readable media, which can be some form of computer program product. Computer readable media can be any available media that can be accessed by processing unit 402. By way of example, and not limitation, computer readable media may comprise computer storage media and communication media. Computer storage media includes volatile and nonvolatile, removable and nonremovable media implemented in any method or technology for storage of information such as computer readable instructions, data structures, program modules, or other data. Combinations of any of the above should also be included within the scope of computer readable media.

In embodiments, one form of computer readable media that may be executed by the controller/processor 304 is the ballistics program 308, as shown in FIG. 3. The ballistics program 308 is any data and/or executable software instructions that provide ballistics information. For example, the ballistics program is the Infinity Suite of exterior ballistics software offered by Sierra Bullets of Sedalia, Mo. Ballistics information is generally defined as any data or information that describes the flight of a projectile, such as a bullet under the influence of environmental, gravitational, or other effects. The ballistics information may be based on information received about the mass of the bullet, the bullet's coefficient of drag or other ballistic coefficients, the muzzle velocity, humidity, barometric pressure, wind velocity, wind direction, altitude, angle of the shot, range, diameter of the bullet, and other considerations. As one skilled in the art will recognize, some or all of this input information can be used to determine characteristics of a bullet's flight.

In other embodiments, a ballistics program calculates ballistics information, which is provided in a look-up table. Thus, rather than calculate the ballistics information, a set of ballistics information is pre-calculated and used by the processor/controller 304. An exemplary look-up table that represents ballistics information appears below:

| Bullet | Bullet | Muzzle | Loss of Elevation | | Correction Required | |
|---|---|---|---|---|---|---|
| Type | Mass | Velocity | 300 yards | 500 yards | 300 yards | 500 yards |
| .223 | 55 grain | 1000 ft/sec | −13.5 inches | −55.3 inches | 4.5 inches | 11.0 inches |
| 300 Ultra | 300 Ultra | 1489 ft/sec | −4.7 inches | −37.6 inches | 1.5 inches | 7.5 inches |

Figure 12:
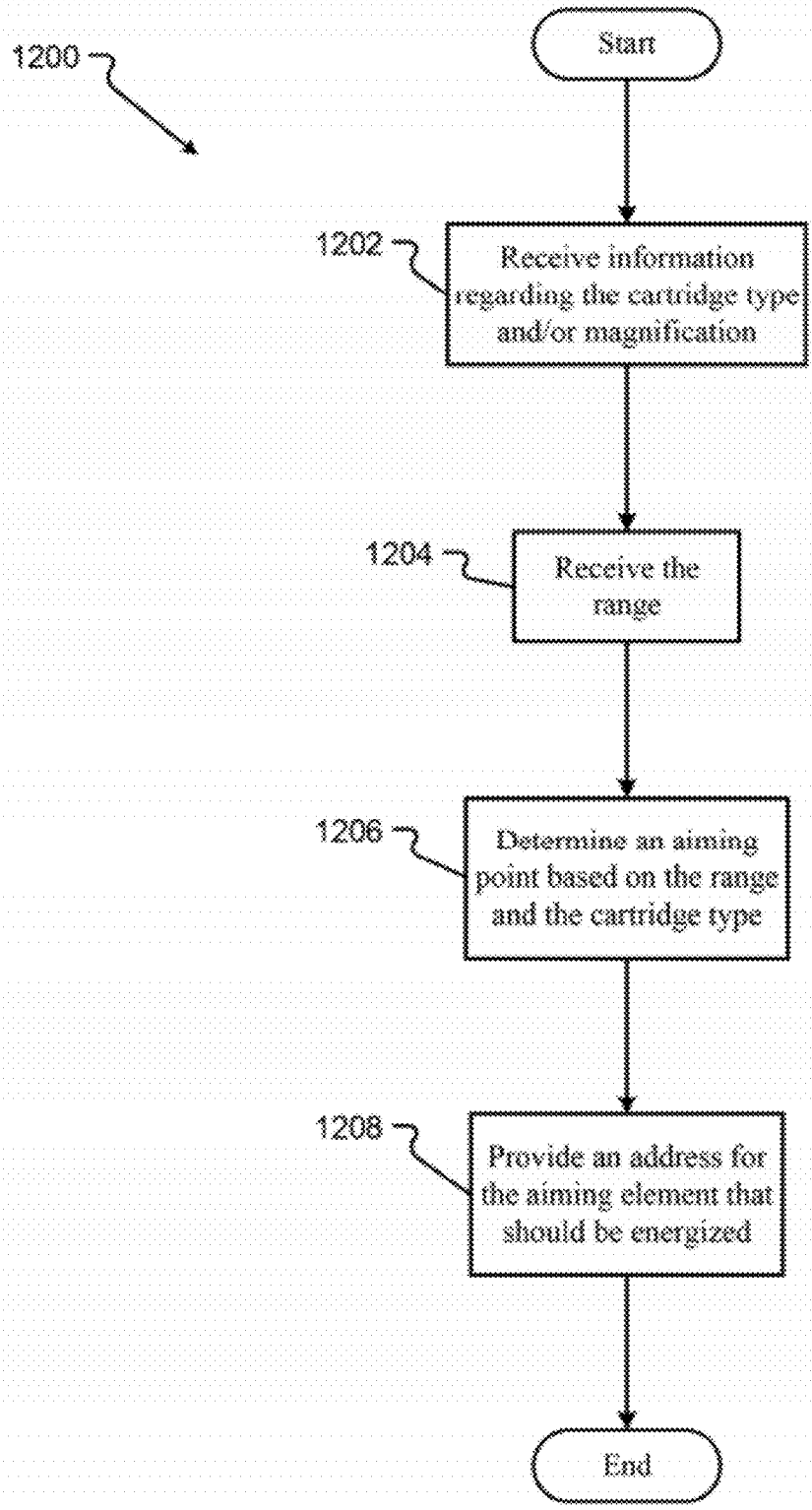
FIG. 12 is an embodiment of a method for generating a range-compensated aiming point.

A software method 1200 for determining which aiming element to energize to make the correct hold over adjustment is shown in FIG. 12. Receive operation 1202 receives cartridge information and the magnification setting for the riflescope. In the exemplary embodiment, a rifleman enters the cartridge type and magnification into an input system, such as input system 306 (FIG. 3). The input system provides the cartridge information and magnification to the software of a controller, such as controller 302 (FIG. 3). Receive operation 1204 receives a range input, such as from a range finder 314 (FIG. 3).

Based on the cartridge type and the range, determine operation 1206 determines the aiming point. In embodiments, the controller executes a ballistics program, such as ballistics program 308 (FIG. 3). In one embodiment, the ballistics program determines the aiming point based on the ballistics motion of the bullet. The aiming point is correlated into an aiming element, such as an LCD element, in an aiming component, such as a transmissive LCD array. Provide operation 1208 provides an address for the aiming element to energize the aiming element. In embodiments, the controller determines the aiming element address and energizes the aiming element at the determined address.

Figure 13:
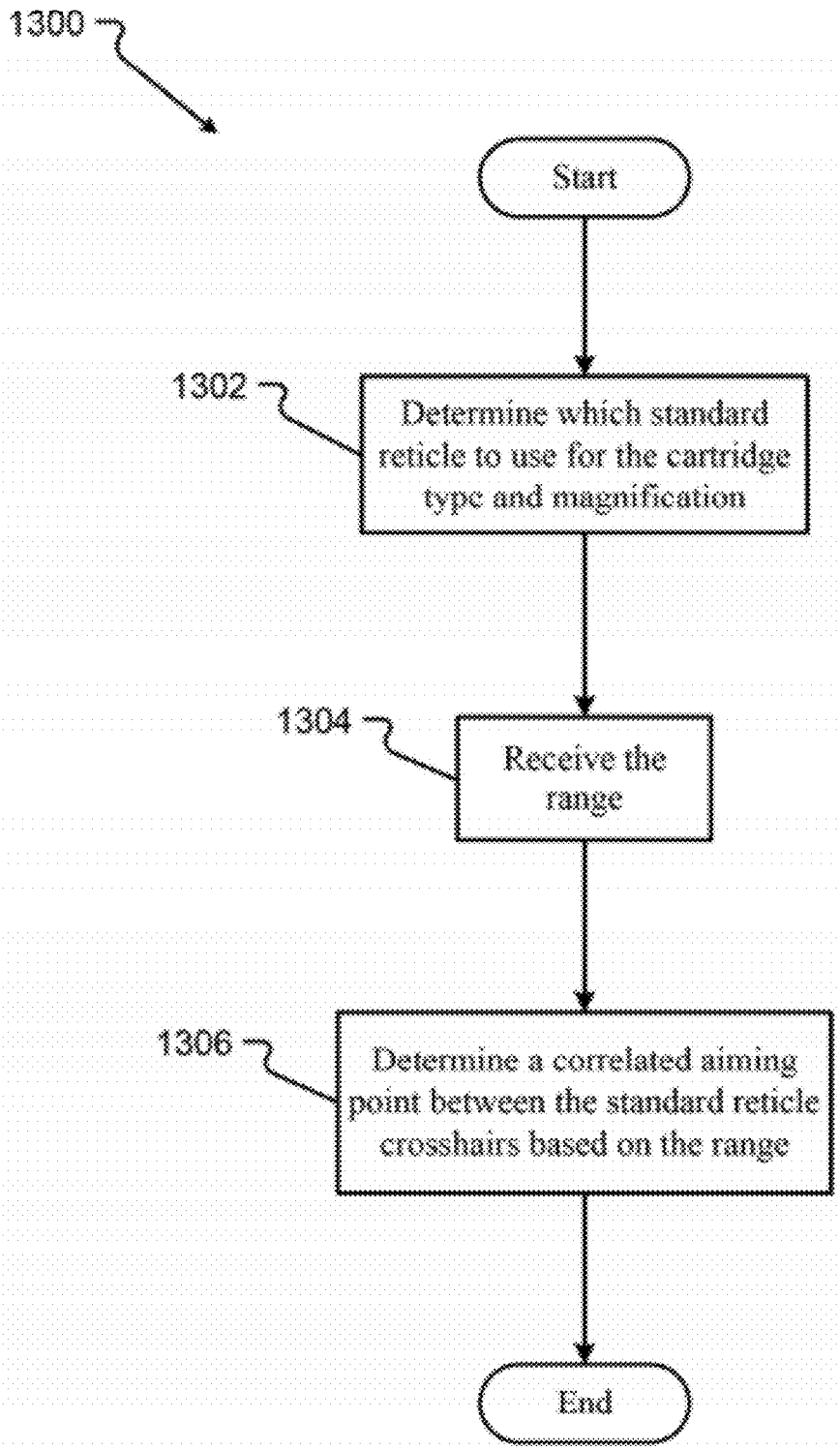
FIG. 13 is an embodiment of a method for determining the proper location for the range-compensated aiming point.

A further embodiment of the determine operation 1206 is shown in FIG. 13. Determine operation 1302 determines a standard reticle that matches the cartridge information. In embodiments, a ballistics program looks up the cartridge type in a look-up table. The look-up table consists of one or more standard reticles that can be used for predetermined cartridge types and predetermined magnification levels. The standard reticles are determined to be "best fit" reticles for predetermined distances under certain magnifications. There may be several standard reticles that may be the best-fit reticle for one or more cartridge types and predetermined magnifications.

Figure 14:
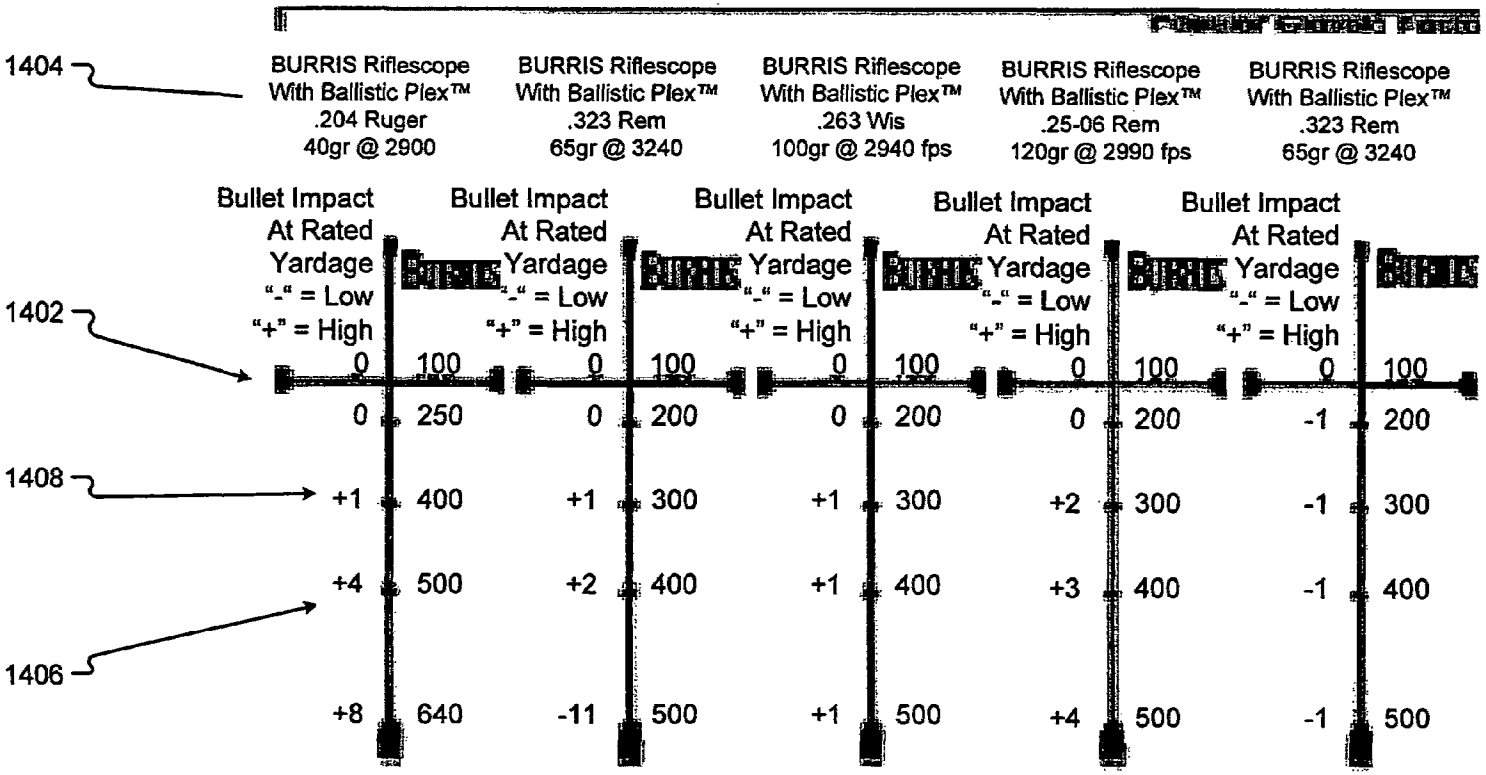
FIG. 14 is an example of ballistics information that could be stored in a look-up table in the memory of the telescopic sight.

An exemplary portion of a look-up 1400 table is shown in FIG. 14. The portion of the look-up table 1400 shows one of the standard reticles 1402 that can be used for a predetermined set of cartridge types, such as .204 Ruger, 40 grain cartridge 1404. The standard reticle 1402 has a set of crosshairs 1406 that can be used for certain predetermined distances. For example, for the .204 Ruger cartridge, the first crosshair is for 250 yards, the second crosshair is for 400 yards, and the third crosshair 1406 is for 500 yards.

This standard reticle 1404 is a "best fit" reticle for all the cartridges shown in the portion of the look-up table 1400. Each cartridge shown for the portion of the look-up table 1400 may have a slight error at one or more of the ranges represented by the crosshairs. For example, at 400 yards, the standard reticle 1402 has an error of 1 inch, represented by the error 1408 shown next to the crosshair.

Referring again to FIG. 13, receive operation 1304 receives the range to the target. In one embodiment, the range is automatically provided from an attached, integrated, or connected range finder. In other embodiments, a rifleman enters the range into the input system, which sends the range to the controller.

Determine operation 1306 determines the correlated aiming point between the crosshairs of the standard reticle. Each crosshair, such as crosshair 1406, in the standard reticle corresponds to a predetermined aiming point element and to a predetermined range. The controller determines between which two crosshairs the received range would fall. For example, if the received range is 266 yards, the received range would fall between the crosshair, on the standard reticle, representing 200 yards and the crosshair representing 300 yards. The controller then determines where the received range would fall between the two crosshairs. For example, the received range 266 yards is two-thirds the distance from 200 yards to 300 yards. Using this information, the controller determines which aiming point between the 200 yard crosshair aiming element and the 300 yard crosshair aiming element corresponds to a range that is two thirds the distance between 200 yards and 300 yards. As such, the controller correlates which aiming element to use.

Referring again to FIG. 3, input system 306 may comprise any device or system for inputting information into the controller/processor 304. Input system 306 may include any input device(s), such as a keyboard, a mouse, a pen, a voice input device, a touch input device, etc. In one exemplary embodiment, the input device 306 is a personal digital assistant, cell phone, or other handheld device that can be communicatively coupled to the controller/processor 304. The handheld device can provide information to the controller/processor, such as bullet characteristics (e.g., bullet mass, bullet type, muzzle velocity, etc.), environmental conditions (e.g., elevation, wind, temperature, humidity, etc.), rifle characteristics, range, or other information. In embodiments, the handheld device may transmit the information from a distance. As such, the rifleman need not carry the handheld device.

Figure 9:
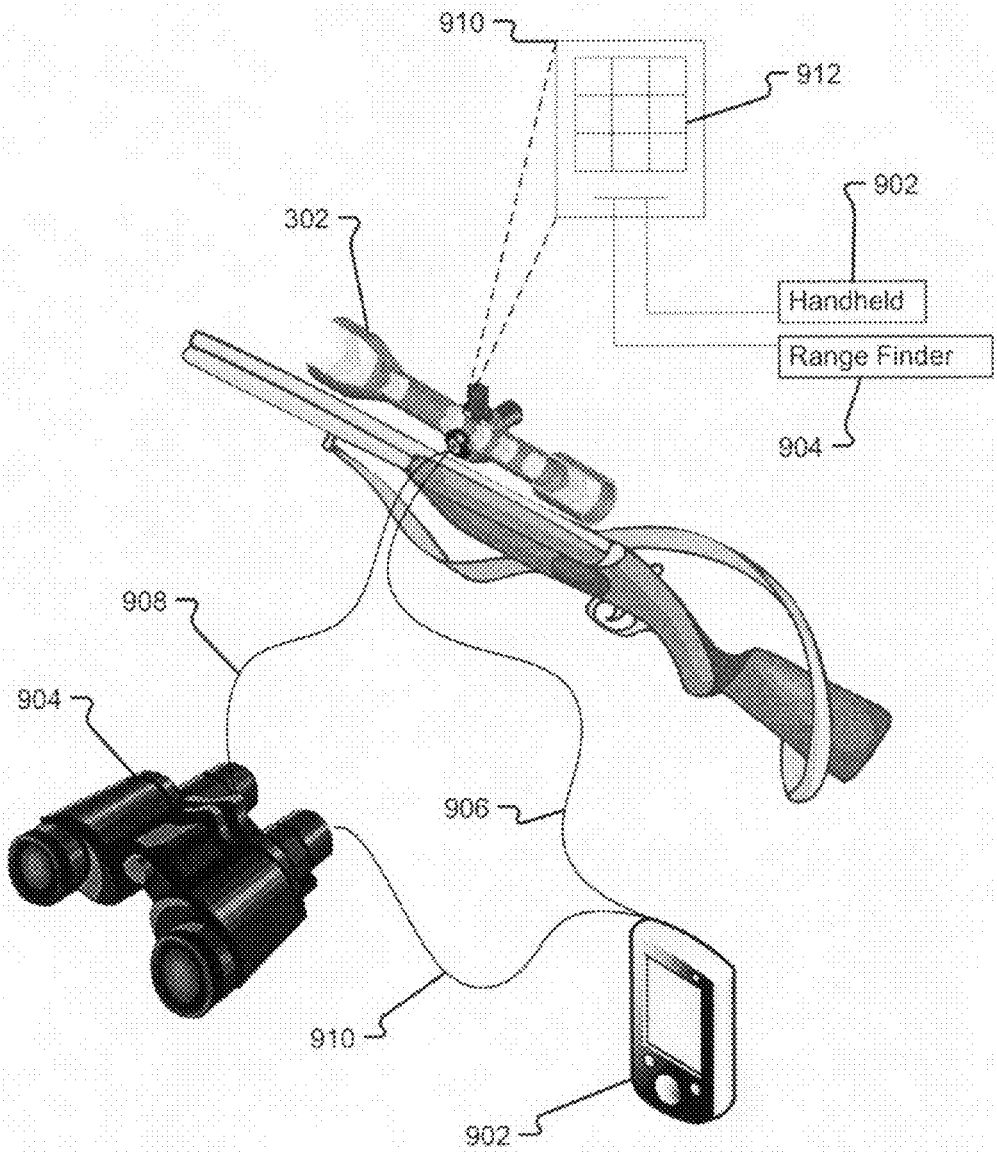
FIG. 9 illustrates yet another embodiment of a trajectory adjusting telescopic sight.

In some embodiments, a user inputs or selects the data in the handheld device to be communicated to the controller/processor 304, but, in other embodiments, the data is automatically received and/or sent to the controller/processor 304. An exemplary system using a handheld device is shown in FIG. 9. The handheld device 902 can receive information and can send information to the controller/processor 304 (FIG. 3) located in the riflescope 302. In embodiments, the handheld device 902 and the riflescope 302 are communicatively coupled with a wired connection 906. In other embodiments, the handheld device 902 and the riflescope 302 are communicatively coupled by a wireless connection, e.g., Bluetooth or IEEE 802.11 connection. In some embodiments, a range finder 904 is communicatively coupled, by a wired or wireless connection 910, to the handheld device 902. This connection allows the range finder 904 to send range data to the handheld device 902 for input into the controller/processor 304 (FIG. 3). In other embodiments, the range finder 904 has a communicative connection 908 to the riflescope 302 for inputting the range data directly or a user reads the range data from the range finder 904 and manually inputs the range data into the handheld device 902.

The handheld device 902 may, in some embodiments, receive information from sensors or other external sources, e.g. weather information from another source, such as NOAA weather broadcast, and sends the information to the controller/processor 304 (FIG. 3). The handheld device 902 may also include sensors, such as a thermometer, barometer, and/or an altimeter, attached to or incorporated into the handheld device 902; the sensors can measure certain environmental conditions that are sent to the controller/processor 304 (FIG. 3).

In another embodiment, the input system 306 is an electromechanical system. For example, the input system 306 may be a punch key, punch pad, or a switch, such as keypad 910 or key 912 shown in FIG. 9. In the exemplary embodiment, a rifleman enters information by depressing one or more keys in a predetermined sequence. The selection of certain data may be aided by a display either in the optic device 302 or separately connected to the controller/processor 304. For example, a rifleman may select the bullet being used by first depressing a key in a predetermined manner or a predetermined number of times to view a menu of bullet types. Then, by using another sequence of depressions of the key, the rifleman may select the appropriate bullet in the menu. This electromechanical system may provide a ruggedized input system that does not require any other devices to enter information into the controller/processor 304.

Output device(s) 310 may include one or more devices to convey data or information to a rifleman, such as a display, speakers, etc. These devices, either individually or in combination can form the user interface used to display information for determining the aiming point and/or displaying the aiming point. In the exemplary embodiment, two particular devices, a transmissive LCD and a LCD/LED display, provide the information to the riflemen.

Figure 5A:
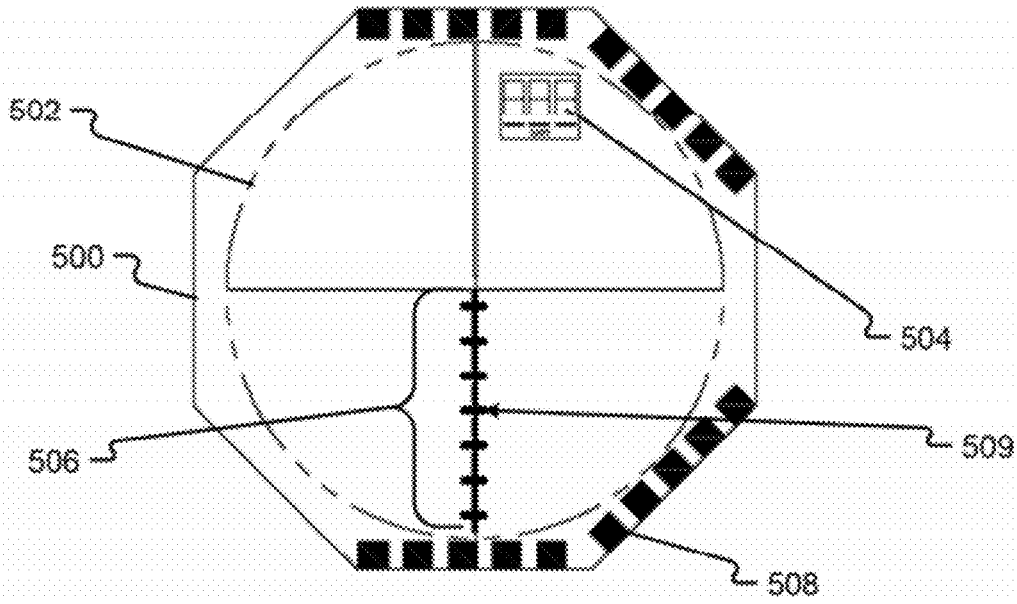
FIGS. 5A and 5B are a front and side perspective view, respectively, of an exemplary embodiment of a transmissive LCD array component according to the present invention.
Figure 5B:
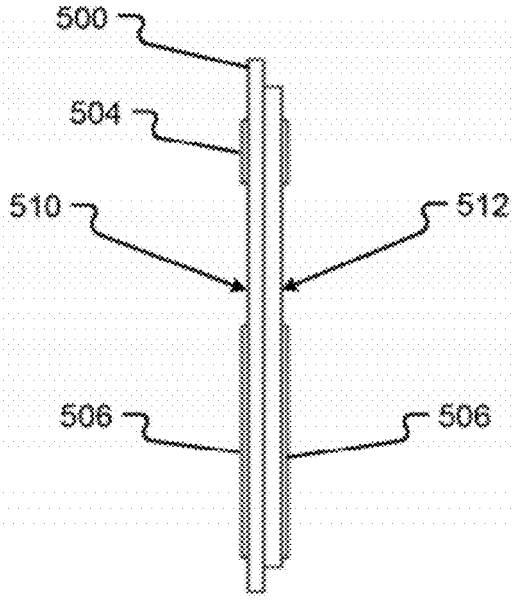

The LCD/LED display 504, as shown in FIG. 5A, provides information about the operation of the sighting system 300 (FIG. 3). The LCD/LED display may be another transmissive LCD, another type LCD, an LED device, or some other type device. In an embodiment, the LCD/LED display 504 provides information about the amount of charge left in the battery that powers the sighting system or information about the range to the target. In other embodiments, the LCD/LED display 504 can provide information about the bullet type and other characteristics input into the controller/processor 304 (FIG. 3) or information derived from the ballistics program 308 (FIG. 3). In other embodiments, the LCD/LED display 504 may display other information not listed herein. The LCD/LED display 504 may also provide a user interface to allow the rifleman to view menus and other possible selections for input into the controller/processor 304 (FIG. 3), as explained in conjunction with the input system 306 (FIG. 3).

The transmissive LCD array component 500 comprises two or more separately addressable LCD elements that are operable to provide an aiming point when one of the LCD elements is addressed or energized by the controller/processor 304 (FIG. 3). A transmissive LCD array component 500 is a display device that allows light to transfer through the LCD elements unless one or more elements of the LCD are energized. An LCD element generally includes a first polarized film, a liquid crystal, and a second polarized film that may be affixed to or integrated with one or more pieces of glass. In one embodiment, a transmissive LCD array 506 is mounted to or affixed to a plano lens or piece of glass of the optic system 302 (FIG. 3) includes a viewing area 502 where a rifleman views the target through the optic system 302 (FIG. 3), as shown in FIG. 5A. The transmissive LCD array is generally shown in FIG. 5A in the area 506 of the viewing area 502. The controller/processor 304 (FIG. 3) energizes LCD elements, such as LCD element 509, within the transmissive LCD array 506 by supplying power to one or more of the contacts 508 that are electrically coupled to the LCD elements. In one embodiment, the controller is connected to the LCD elements internal to the riflescope. In the exemplary embodiment, one polarized film and the liquid crystal is placed on a first face 510 of the plano 502, and the second polarized film is placed on a second face 512 of the plano 502.

Figure 6A:
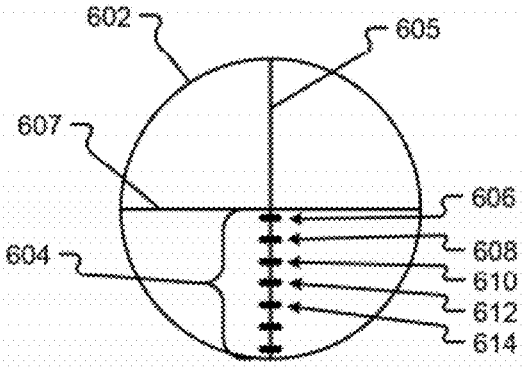
FIGS. 6A-6D are exemplary embodiments of a lens having superimposed thereon alternative configurations of the transmissive LCD array according to various embodiments of the present invention.

The transmissive LCD array may have a plurality of configurations, as shown in FIGS. 6A-6D. FIGS. 6A-6D show several embodiments of transmissive LCD arrays, with each LCD element energized to more completely show the configurations of the transmissive LCD arrays. However, as one skilled in the art will recognize, only one LCD element may be energized when providing an aiming point. In a first lens embodiment 602, the transmissive LCD array 604, as shown in FIG. 6A, comprises two or more LCD elements that are spaced along the vertical crosshair 605 and below the horizontal crosshair 607. The controller/processor 304 (FIG. 3) can energize one of the two or more LCD elements to provide an aiming point. The distribution along the vertical crosshair 605 can provide different adjustments depending on the range of the anticipated shot.

Figure 6B:
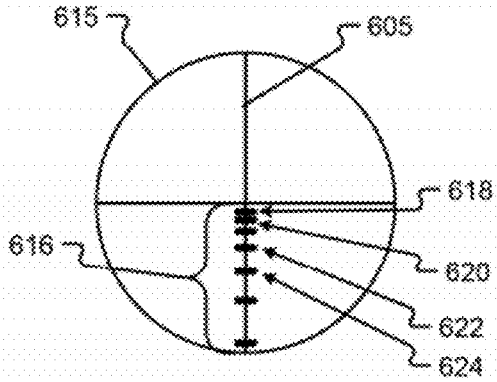

Another lens embodiment 615 of the transmissive LCD array 616 is shown in FIG. 6B. The transmissive LCD array 616 also provides a series of LCD elements arranged along the vertical crosshair 605. The LCD elements 618, 620, 622 and 624 are spaced non-uniformly to compensate for the nonlinear effect gravity has on the bullet. For example, the LCD element 618 provides the aiming point for 100 yards. Each successive LCD element 620, 622 and 624 is spaced a little further from the preceding LCD element. For instance, the spacing between LCD element 618 and LCD element 620 is less than the spacing between LCD elements 620 and 622, which in turn is less than the spacing between LCD elements 622 and 624. Both lens embodiments 602 and 615 include transmissive LCD arrays 604 and 616 that provide aiming points in only one plane. However, if windage is a concern, LCD arrays 604 and 616 may be less effective in aiming the rifle because there are no LCD elements to compensate for windage.

Figure 6C:
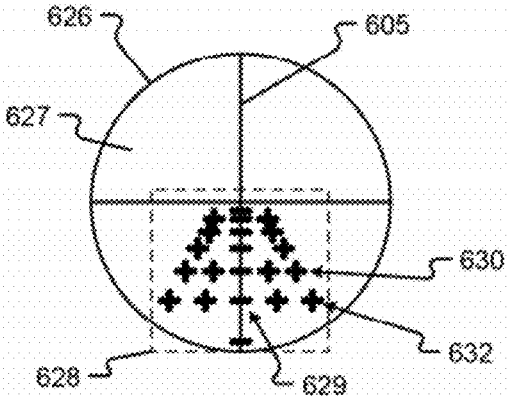

Another lens 626 includes an alternative embodiment of an LCD array 628 as shown in FIG. 6C. The LCD array 628 includes a plurality of LCD elements 629 along the vertical crosshair 605, similar to LCD array 616. However, there are also several LCD elements in the field of view 627 that are separate from the vertical crosshair 605, such as LCD elements 630 and 632. The LCD elements that are separated or removed from the vertical crosshair 605 provide a possible aiming point that can also compensate for the effect of windage. The controller/processor 304 (FIG. 3) can use the input wind speed and range to determine if one of the separated or removed LCD elements, e.g., 632, should be used as the aiming point.

Figure 6D:
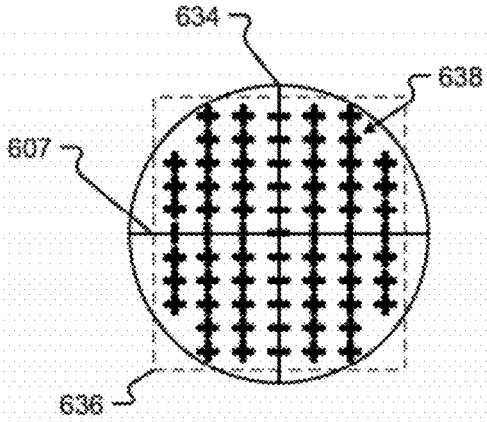

Another lens embodiment 634 includes an affixed LCD array 636, as shown in FIG. 6D. This exemplary embodiment of the LCD array 636 provides a uniformly spaced set of LCD elements that cover a portion of the lens 634 both above and below the horizontal crosshair 607. In embodiments, the exemplary LCD array 636 can be used to help "zero" the riflescope. For example, if several shots are fired from the rifle with the center of the reticle centered on the target, the shots may be grouped visually around one of the LCD elements, such as LCD element 638. The rifleman may choose the LCD element 638 as the LCD element for which the shots are visually grouped. The controller/processor 304 (FIG. 3) can then compute a vertical and horizontal correction to zero the riflescope such that the groups will be visually centered on the center of the reticle.

Figure 7:
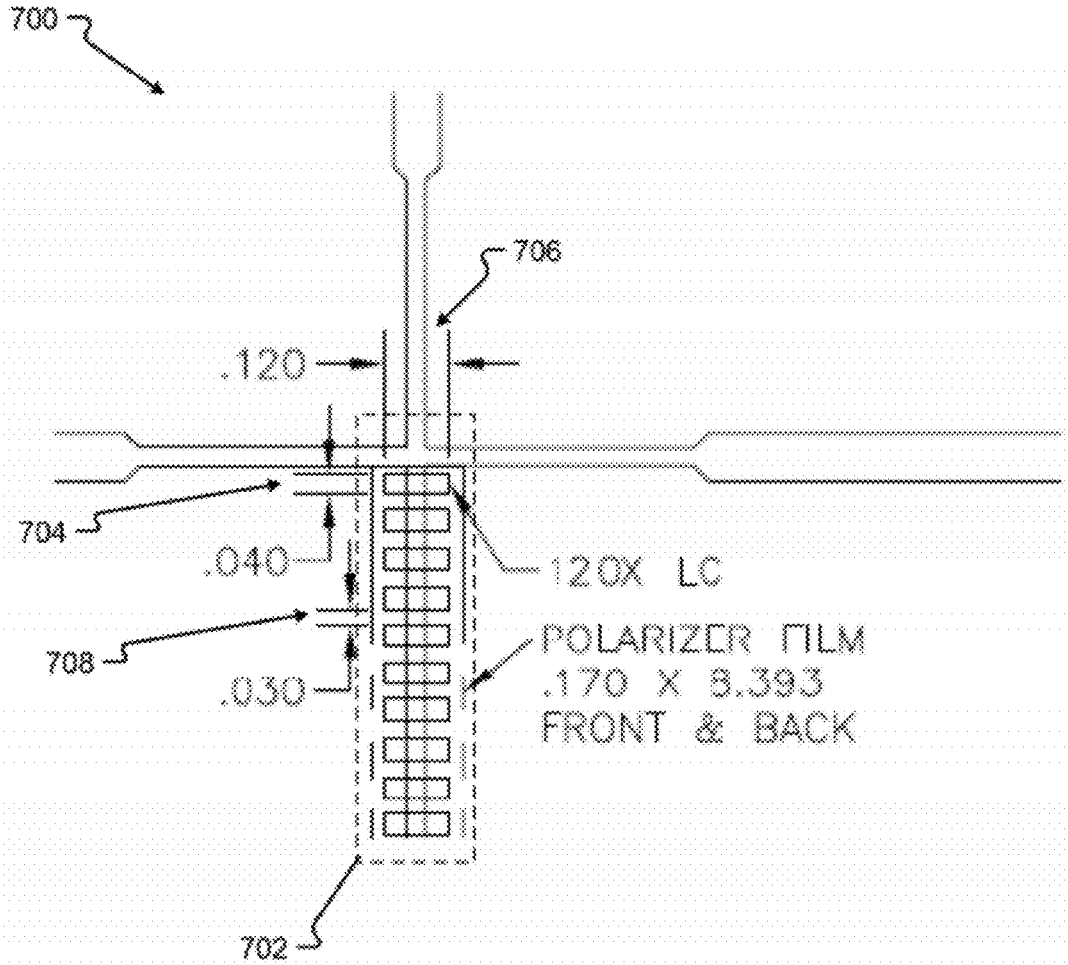
FIG. 7 is an enlarged view of an exemplary embodiment of the transmissive LCD array having exemplary dimensions according to the present invention.

An enlarged view of another embodiment of an LCD array 700 is shown in FIG. 7. The LCD array 700 consists of two or more LCD elements, as represented by box 702. The LCD elements can be spaced along the vertical crosshair or below the horizontal crosshair to the end of the viewing area. There may be tens, hundreds, or thousands of LCD elements between the horizontal crosshair and the end of the viewing area. In the exemplary embodiment, the LCD elements 702 are adjacently spaced in close proximity. The spacing of the LCD elements 702 allows for fine granularity of aiming using the LCD elements 702 even at very long ranges. For example, at 500 yards, the LCD granularity may provide aiming accuracy to within five inches or less. The LCD array 700 in FIG. 7 provides an exemplary spacing. Each LCD element 702 has a height 704 of 0.040 inches and a width 706 of 0.120 inches. Each LCD element has spacing 708 from adjacent LCD element(s) of 0.030 inches. In preferred embodiments, the LCD size, represented by the height 704, width 706 and spacing 708, is no larger than the dimensions shown in FIG. 7 and, more preferably, the spacing 708 between LCD elements 702 may be less than 0.030 inches.

Further embodiments of transmissive LCD array components are shown in FIGS. 10A through 10C. Transmissive LCD array component 1002 has a horizontal crosshair 1006 but a vertical crosshair 1008 that is not superimposed in the field of view below the horizontal crosshair 1006. In embodiments, an LCD element 1010, selected and energized by the controller/processor 304 (FIG. 3), provides the only aiming point below the horizontal crosshair 1006. In the example shown in FIG. 10A, the crosshair 1006 looks like a cross, i.e. "+". However, one skilled in the art will recognize that the crosshair may have other shapes, such as a box, dot, bull's eye, etc. In another embodiment, the controller/processor 304 (FIG. 3) determines an aiming point in the transmissive LCD array component 1002, in FIG. 10B, that cannot be represented by a single LCD element. In this embodiment, two LCD elements 1014 are energized on the vertical crosshair 1012 to suggest to the rifleman that the aiming point is between the LCD elements 1014. In a further embodiment, the aiming point may not be halfway between the two LCD elements 1014. In this situation, as seen in FIG. 10C, one or more LCD elements, such as LCD element 1020 may be giving a different shading, color, or appearance. Thus, LCD element 1020 appears to be grey and LCD element 1022 appears to be black, which suggests that the aiming point is nearer LCD element 1022 than LCD element 1020. In other embodiments, one or more LCD elements are colored to make suggestions of possible aiming points. These embodiments become very useful in short range shots where the granularity of the LCD array explained in conjunction with FIG. 7 is not fine enough to provide an exact aiming point with the available LCD elements.

Figure 2A:
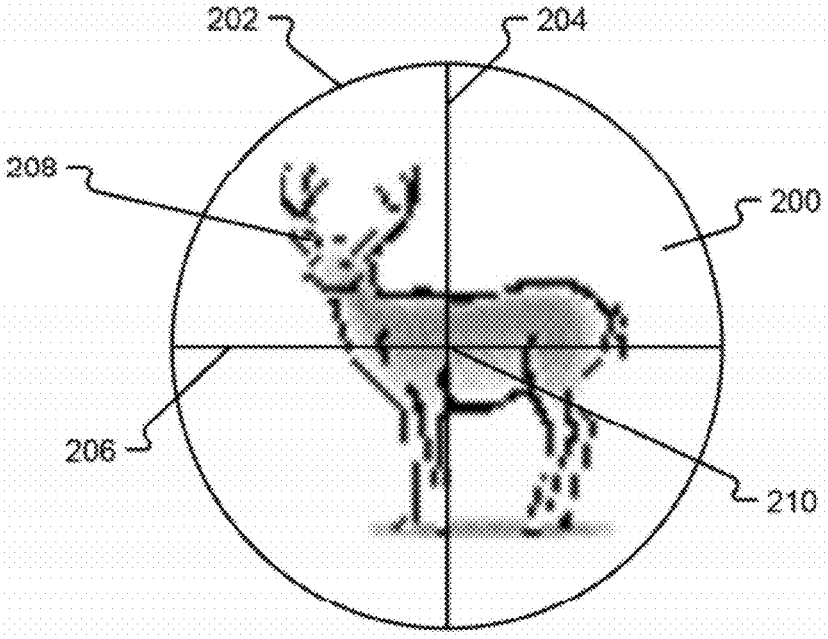
Fig. 2A Prior Art
FIGS. 2A and 2B are simplified representations of the field of view from a rifle scope and different aiming situations often encountered by riflemen.
Figure 2B:
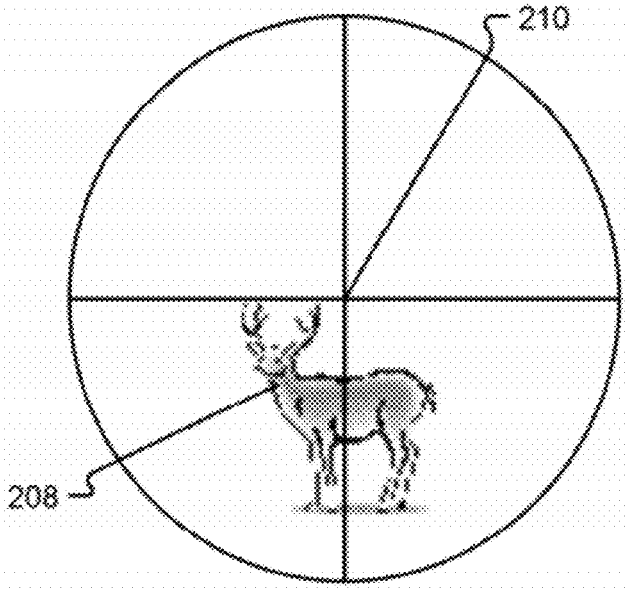
Fig. 2B Prior Art
Figure 8:
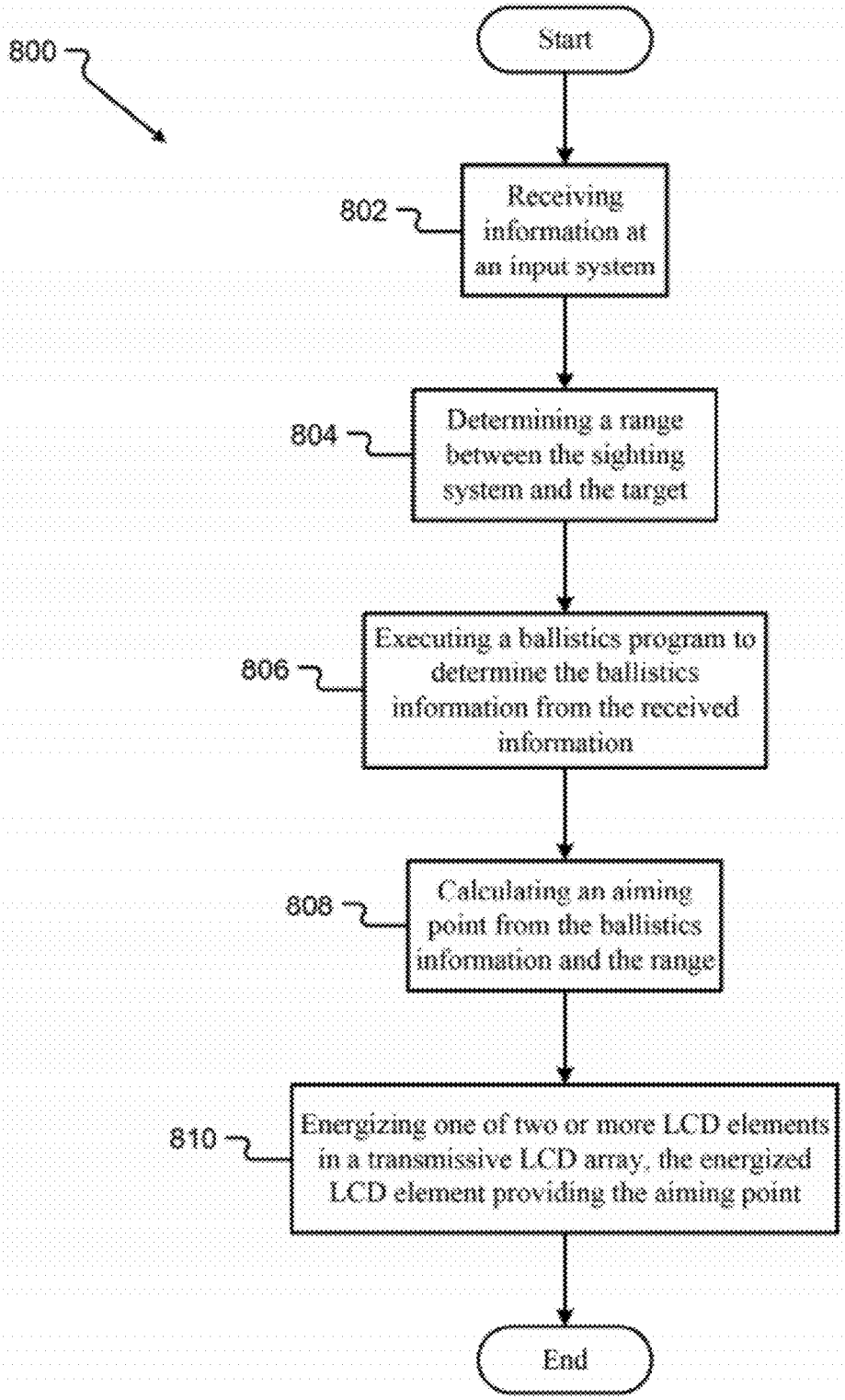
FIG. 8 is a flow diagram according to the present invention for automatically providing an aiming point.

FIG. 8 illustrates a method 800 for automatically displaying an aiming point. Receive operation 802 receives information from an input system, such as input system 306 (FIG. 3). In embodiments, the received information includes information about the ammunition being used, e.g., bullet type or muzzle velocity, firearm information, e.g., rifle type, and or environmental information, e.g., windage, elevation, temperature, humidity, etc. Determine operation 804 determines the range, i.e., distance, between the sighting system, such as sighting system 300 (FIG. 3), and the intended target, such as target 208 (FIG. 2). In embodiments, the rifleman uses a rangefinder, such as range finder 314 (FIG. 3), to determine a highly accurate range to the target.

Execute operation 806 executes a ballistics program, which, in some embodiments, includes referencing a lookup table, such as ballistics program 308 (FIG. 3) to determine the relevant ballistics information from the received information. In embodiments, the ballistics information includes a vertical drop for the bullet over the range intended for the shot, and the amount of correction required to compensate for the bullet drop. Calculate operation 808 uses the ballistics information and the range to determine an aiming point. A controller/processor, such as controller/processor 304 (FIG. 3), calculates the appropriate LCD element, such as LCD element 630 in transmissive LCD array 628 (FIG. 6C) will compensate for bullet drop and any other considerations, such as windage. The calculated aiming point instructs the rifleman how to aim to effectively strike the intended target.

Energize operation 810 addresses or energizes the appropriate LCD element for the calculated aiming point. In embodiments, the energized LCD element or aiming point, such as LCD element 622 (FIG. 6B), is located on the vertical crosshair 605. In other embodiments, the aiming point or energized LCD element, such as LCD element 632 (FIG. 6C), is in the field of view but removed or separated from the vertical crosshair 605. Such an aiming point allows the sighting system to compensate for both hold over and windage. In other embodiments, energize operation also energizes an LCD/LED display, such as LCD/LED display 504 (FIG. 5), to display the range or other information.

Figure 15:
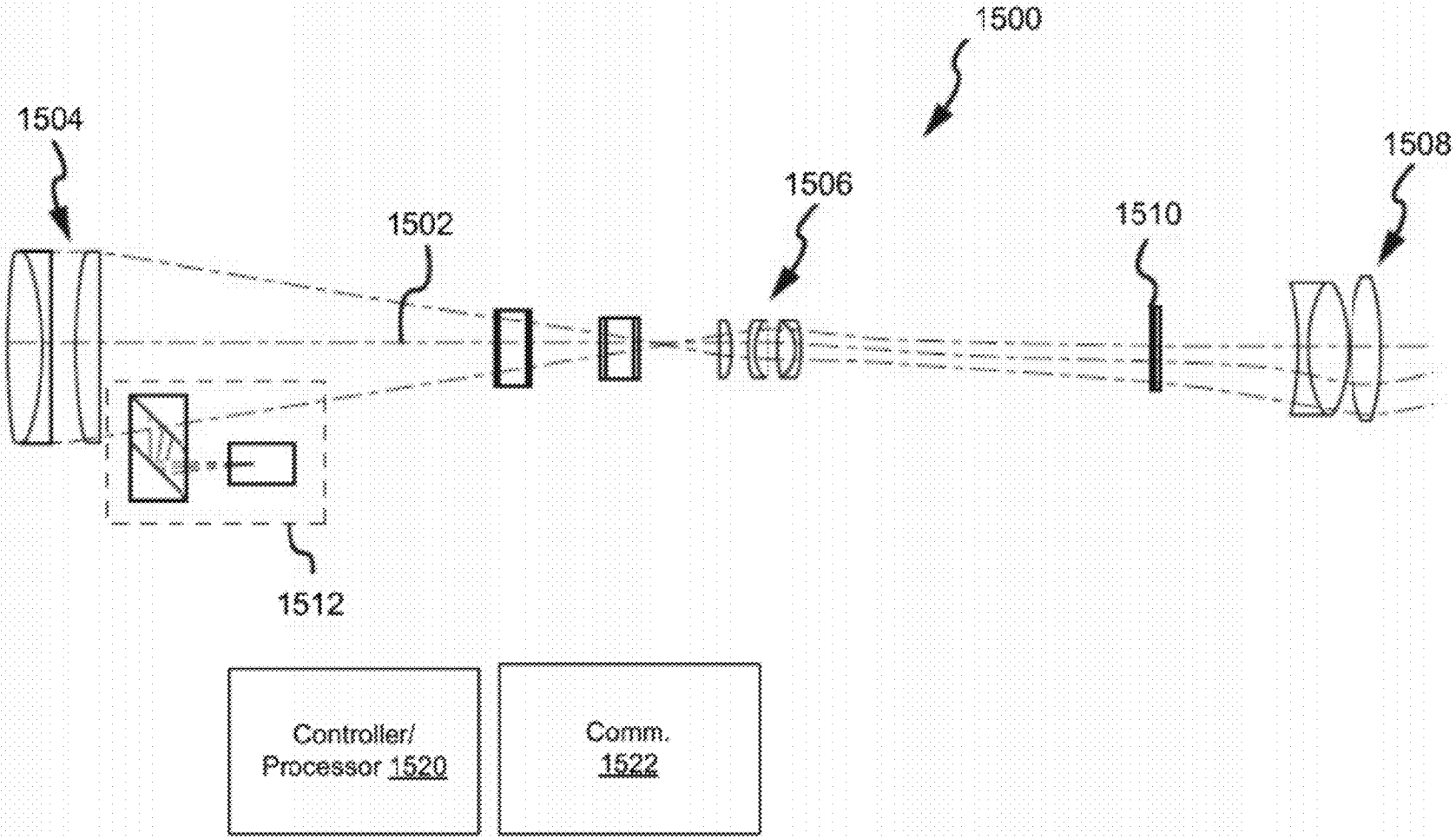
FIG. 15 illustrates yet another embodiment of a trajectory adjusting telescopic sight.

FIG. 15 illustrates yet another embodiment of a trajectory adjusting telescopic sight. The telescopic sight includes a set of lenses disposed along a linear optical path 1502 including an objective lens 1504 or lens assembly, an erector lens assembly 1506 and ocular lens 1508 or lens assembly. In the embodiment shown, the aiming component is incorporated into a transmissive plano 1510 disposed along the optical path 1502 of the scope 1500. As described above, the aiming component may be an LCD or LED (e.g., an OLED) array of multiple individual LCDs or LEDs. For the purposes of this description of FIG. 15, the aiming component will be referred to as a light-generating OLED.

In the scope embodiment shown, the laser rangefinder assembly 1512 is illustrated. The rangefinder is disposed between the objective lens 1504 and the erector lens assembly 1506. The rangefinder 1512 includes a rangefinding light transmitter that transmits a beam through the objective along the linear optical path and a rangefinding light receiver that receives the rangefinding light reflected back to the telescopic sight along the linear optical path through the objective lens. The rangefinder generates a range signal indicative of a range of the target object reflecting the rangefinding light.

The rangefinder signal is then provided to the controller 1520. The controller 1520 includes a memory storing ballistics information, such as in the form of a lookup table as described above. Based on the ballistics information and the rangefinder signal, the controller 1520 determines which OLEDs on the plano 1510 to illuminate in order to present an aiming point that compensates for the range of the target. The controller 1520 is provided with a communication port 1522 through which ballistics information, reticle shapes and user selections (e.g., of color, ammunition type and reticle shape) may be uploaded in the sight's memory.

In the embodiment shown, the plano 1510 is perpendicular to the linear optical path and located at a second focus point between the erector lens assembly 1506 and the ocular lens 1508. By being perpendicular to the optical path no parallax is introduced into the sight 1500. The LEDs are oriented so that light emitted by the LEDs are directed out the ocular lens 1508. This prevents light generated by the LEDs from exiting the scope through the objective lens 1504. Other steps may be taken to further prevent any unwanted leakage of LED light through the objective lens 1504. For example, the internal components of the scope, e.g., between the plano 1510 and the ocular lens 1508, may be coated with material that selectively absorbs the wavelengths of the light generated by the LEDs (noting that different colors may be used) to prevent reflection. Similarly, one or more lens in the objective or erector assembly may be coated to prevent LED-generated light from getting out through the objective. Other methods of preventing reflected LED light may be used also.

In an embodiment, the controller illuminates specific LEDs to create a visible reticle viewable by a user through the ocular lens so that the light-emitting reticle is co-located with the determined aiming point. The shape of the reticle may be determined by the controller 1520 and may be selected from one or more predetermined reticle shapes stored in memory. In an embodiment, a user through an interface may be able to select or change the reticle shape used by the sight 1500.

The plano 1510 may or may not include a mechanical reticle etched into on the plano 1510. In an embodiment, LEDs may be provided specifically to illuminate the mechanical reticle to assist its contrast in low light conditions. In an embodiment, a user may be able to select different colors for illuminating the mechanical reticle and providing the range-compensated aiming point.

The illuminated aiming component is particularly useful in low light conditions when the amount of light available to provide contract with a non-illuminated mechanical crosshair is very low. In an embodiment, a light sensing element may be used to selectively energize the LEDs that light up the mechanical crosshairs based on the current light conditions. In an alternative embodiment, an adjustment knob may be provided to allow the user to increase or decrease the light generated by the LEDs on the plano depending on the current conditions.

Although the present invention has been described in language specific to structural features and methodological acts, it is to be understood that the present invention defined in the appended claims is not necessarily limited to the specific structure or acts described. One skilled in the art will recognize other embodiments or improvements that are within the scope and spirit of the present invention. Therefore, the specific structure or acts are disclosed as exemplary embodiments of implementing the claimed invention. The invention is defined by the appended claims.

What is claimed is:

1. A telescopic sight for firearms comprising:

a set of lenses disposed along a linear optical path including an objective lens, an erector lens assembly and ocular lens;

a rangefinding system including a rangefinding light transmitter adapted to transmit a beam through the objective along the linear optical path and a rangefinding light receiver adapted to detect rangefinding light reflected back to the telescopic sight along the linear optical path through the objective lens, wherein the rangefinding light receiver generates a range signal indicative of a range of an object reflecting the rangefinding light;

a lookup table stored in a memory containing ballistics information;

a processor that, based on the range signal and the ballistics information, determines an aiming point relative to the linear optical path;

a plurality of LEDs on a transmissive plano located on the linear optical path and the LEDs oriented to emit light substantially only along the optical path toward the ocular lens; and the processor further adapted to selectively illuminate one or more LEDs to form a light-emitting reticle viewable by a user through the ocular lens so that the light-emitting reticle is co-located with the determined aiming point.

2. The telescopic sight of claim 1 wherein the transmissive plano is on and perpendicular to the linear optical path and located at a focus point between the erector lens assembly and the ocular lens.

3. The telescopic sight of claim 1 wherein the plano includes at least one mechanical crosshair integrated into the plano.

4. The telescopic sight of claim 3 wherein the mechanical crosshair is illuminated by light generated from at least one illuminated LED.

5. The telescopic sight of claim 1 wherein the memory includes a plurality of reticles and the processor selectively illuminates one or more LEDs to form one of the plurality of reticles based on a selection received from a user.

6. The telescopic sight of claim 5 further comprising:

a communication port through which the processor can receive a user-selection of a reticle from the plurality of reticles.

7. The telescopic sight of claim 1 further comprising:

a communication port through which the telescopic sight can receive one or more of a reticle and ballistics information for storage in the memory.

8. The telescopic sight of claim 1 wherein the plurality of LEDs include LEDs of different colors and the processor selectively illuminates one or more LEDs of a first color to form a reticle based on a selection of the first color received from a user.

9. The telescopic sight of claim 1 wherein an interior surface of the telescopic sight between the transmissive plano and the ocular lens are coated with a material that selectively absorbs light of a wavelength emitted by the LEDs.

10. An illuminated sighting system for visually acquiring a target, comprising:

a set of lenses disposed along a linear optical path including an objective lens, an erector lens assembly and ocular lens;

a memory containing ballistics information and a plurality of reticle shapes;

a processor that, based on a range signal and the ballistics information, determines an aiming point relative to the linear optical path;

a plurality of LEDs on a plano located on the linear optical path and the LEDs oriented to emit light along the optical path toward the ocular lens; and the processor further adapted to selectively illuminate one or more LEDs to form a light-emitting reticle having a shape corresponding to a selected one of the plurality of reticle shapes, wherein the light-emitting reticle is co-located with the determined aiming point.

11. The sighting system of claim 10, wherein the aiming component is a transmissive LED array on the plano.

12. The sighting system of claim 10, further comprising at least one mechanical crosshair disposed between the LED array and the ocular lens.

13. The sighting system of claim 12, wherein at least one LED on the plano is provided to illuminate the mechanical crosshair.

14. The sighting system of claim 13, wherein the at least one LED on the plano provided to illuminate the mechanical crosshair includes a first crosshair LED of a first color and a second crosshair LED having a second color.

15. The sighting system of claim 14, wherein the controller selectively illuminates one of the first crosshair LED and the second crosshair LED based on a user selection stored in memory.

16. A method for generating an aiming point for a sighting system in low light conditions comprising:

determining a range between the sighting system and a target;

determining an aiming point from ballistics information and the range; and energizing a plurality of LED elements on a plano located on an optical path provided by the sighting system that transmits an image of the target to a user's eye, thereby providing a light-emitting reticle superimposed on the target.

17. The method of claim 16 further comprising:

preventing light generated by the LEDs from exiting an objective lens of the sighting system.

18. The method of claim 16 further comprising:

identifying a previously selected reticle shape from a plurality of reticle shapes stored in memory; and energizing the plurality of LED elements to form the previously selected reticle shape.

19. The method of claim 16 further comprising:

identifying a previously selected reticle color indicator stored in memory; and energizing the plurality of LED elements to form a reticle in a color indicated by the previously selected reticle color indicator.

* * * * *